US006561092B1

(12) United States Patent
Surbrook

(10) Patent No.: US 6,561,092 B1
(45) Date of Patent: May 13, 2003

(54) INK FLOW ADJUSTMENT DEVICE FOR PRINTING PRESSES

(76) Inventor: Steven R. Surbrook, 14310 NE. 7th Pl., Apt. #4, Bellevue, WA (US) 98007

( * ) Notice: Subject to any disclaimer, the term of this patent is extended or adjusted under 35 U.S.C. 154(b) by 182 days.

(21) Appl. No.: 09/667,824

(22) Filed: Sep. 22, 2000

(51) Int. Cl.[7] ..... B41F 31/02

(52) U.S. Cl. ..... 101/365; 101/483; 101/350; 101/157

(58) Field of Search ..... 101/365, 350, 101/363, 157, 169, 483; 118/261

(56) References Cited

U.S. PATENT DOCUMENTS 4,461,209 A * 7/1984 Washchynsky et al. ..... 101/365
4,479,434 A * 10/1984 Armelin ..... 101/365
4,655,133 A * 4/1987 O'Dea et al. ..... 101/363
4,669,382 A * 6/1987 Jentzsch et al. ..... 101/365
5,052,297 A * 10/1991 Albiez ..... 101/365
5,233,922 A * 8/1993 Stirbis et al. ..... 101/363
5,694,851 A * 12/1997 Bruni ..... 101/365
6,112,661 A * 9/2000 Albiez ..... 101/365

FOREIGN PATENT DOCUMENTS

FR 2 778 364 11/1999
WO WO 98 13202 4/1998

* cited by examiner

*Primary Examiner*—Eugene H. Eickholt
(74) *Attorney, Agent, or Firm*—Merchant & Gould P.C.

(57) ABSTRACT

The devices are held in place by a hollow fastener which engages the threaded holes in the printing press which accommodated prior art adjustment devices. A pin moves endwise in the screw and its endwise motion adjusts ink flow. The pin is moved endwise by a lever assembly operated eccentric mechanism. The handle of the lever assembly extends through a slot in a calibrated faceplate, giving clear indication of the setting of the device.

20 Claims, 4 Drawing Sheets

INK FLOW ADJUSTMENT DEVICE FOR PRINTING PRESSES

BACKGROUND OF THE INVENTION

1. Field

The subject invention is in the field of printing presses, particularly those used in printing newspapers. More particularly, it is in the field of apparatus and devices used to adjust and control the flow rate and flow distribution of the printing ink. The printing is done on a moving sheet of paper and the required amount and distribution of ink across the width of the sheet depends on the copy being printed. The distribution is adjusted across the width of the printed material.

2. Prior Art

In some printing operations the ink flow is automated. The copy is assessed and ink flow distribution is adjusted accordingly, possibly by remote control. The ink is dispensed through a slit and the gap of the slit is mechanically adjusted by a bank of adjustment mechanisms, spaced evenly apart at distances no greater than 1.5 inches. Since this technique is too expensive for all but the largest printing operations, the most widely used adjustment mechanism currently is a thumbscrew. The screw itself is often one quarter inch in diameter and has a knob about three quarters to seven eights of an inch in diameter. Turning the screws into the threaded holes reduces ink flow and vice versa. It is not possible to determine the setting of screws by looking at them. Adjustment of ink flow is a cut and try process. The printed sheet is studied to determine what adjustments are needed. Adjustments are made manually and the process is repeated until the desired results are achieved. The amount of adjustment of each screw is not precise. This procedure uses significant amounts of time and significant amounts of paper are wasted. Accordingly, the primary objective of the subject invention is to provide an ink flow adjustment device which provides a clear indication of the setting of the device and is ergonomically advantageous. Other objectives are that installation of the device require no modification of the press and that the device be durable.

SUMMARY OF THE INVENTION

The subject invention is an ink flow adjustment device for newspaper printing presses. The device is held in place by a screw which replaces the conventional adjustment screw. The attachment screw is hollow and a rod extends through and somewhat beyond the end of the screw to contact the ink metering slit. Endwise movement of this pin adjusts the flow of ink at the location of the device. The pin is moved by a lever operated eccentric. The handle of the lever assembly extends through a slot in a faceplate. Numerals imprinted along the sides of the slot give clear indication of the setting of the device. The device is described in more detail below with reference to the attached drawings.

DETAILED DESCRIPTION OF THE INVENTION

Figure 1:
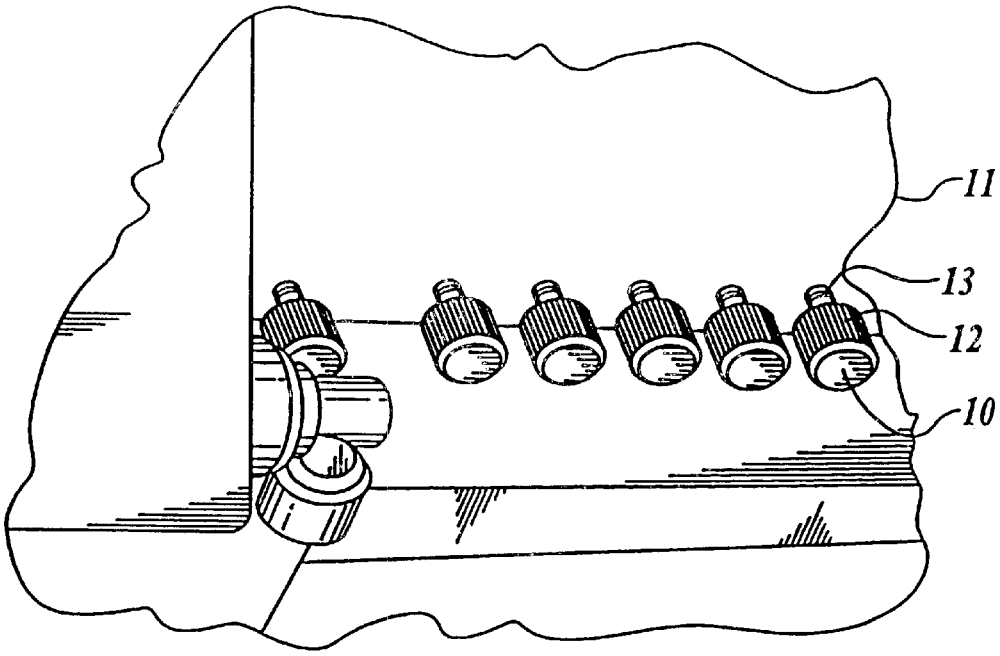
Fig. 1 (PRIOR ART)
FIG. 1 illustrates a common prior art adjustment device.

The subject invention is an ink flow adjustment device for printing presses such as those used to print newspapers. FIG. 1 illustrates a common prior art adjustment device 10 installed and ready for use on press 11. The device is a thumbscrew, having knurled knob 12 and a threaded shank 13. The devices are installed across the width of the printing, commonly evenly spaced a distance apart in a range of 0.75 to 1.5 inches. Rotating a device by its knob counterclockwise increases flow in the portion of the nozzle influenced by the device and vice versa.

Figure 2:
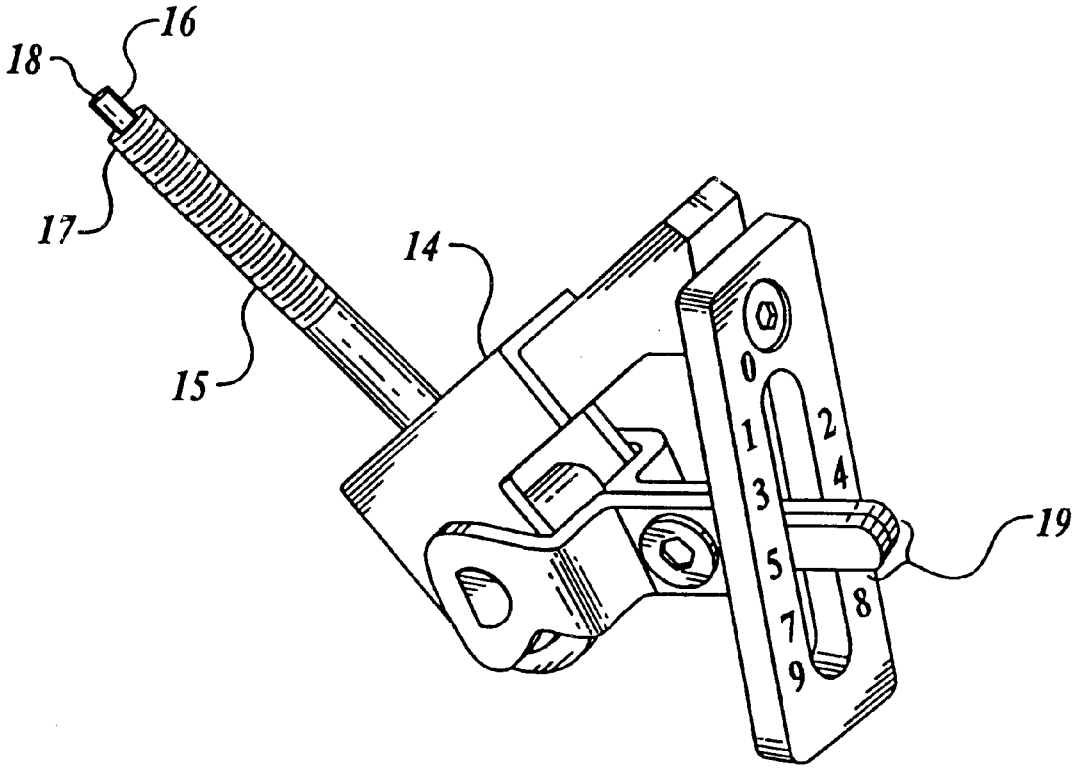
FIG. 2 is a general view of a preferred embodiment of the subject device.

FIG. 2 is a general view of a preferred embodiment of the subject device 14. The device is held in place by fastener 15 which fits in the threaded hole provided for each prior art device. Fastener 15 is hollow and rod 16 extends through it and beyond end 17. Endwise movement of end 18 of pin 16 adjusts ink flow. Pin 16 is moved endwise by lever assembly handle 19 as explained below. Movement of the handle toward lower numbers, number 1 being typical, extends pin 16 to decrease ink flow and vice versa.

Figure 3:
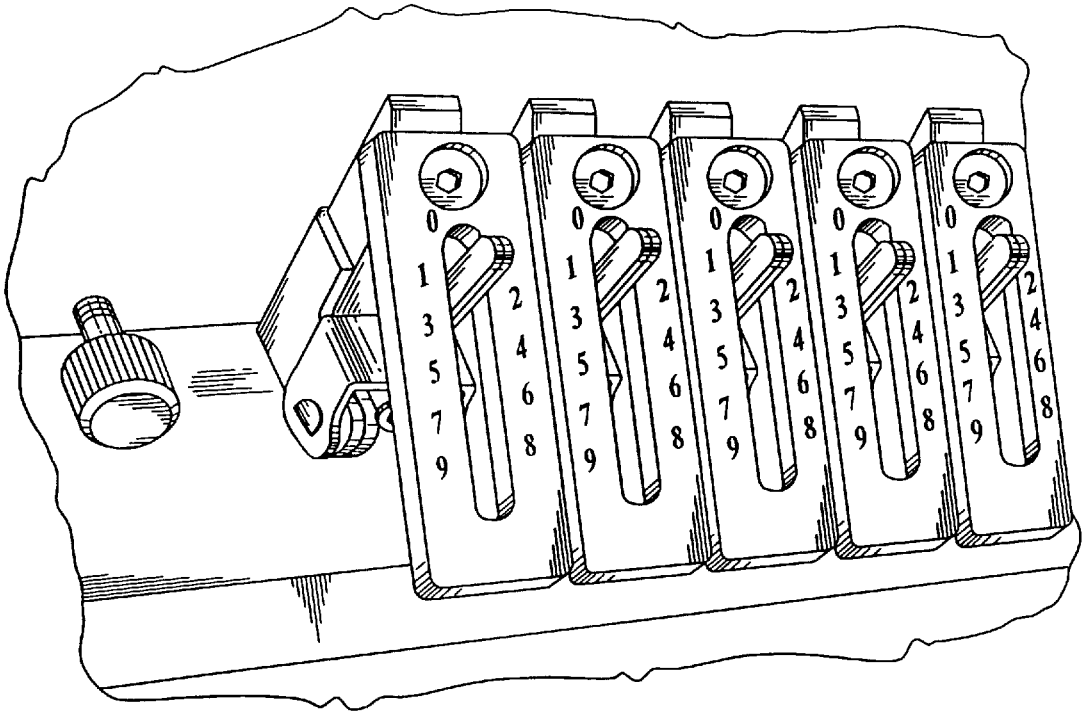
FIG. 3 illustrates the subject devices installed in place of the devices shown in FIG. 1.

FIG. 3 illustrates a plurality of the subject devices installed in place of the prior art devices shown in FIG. 1.

Figure 4:
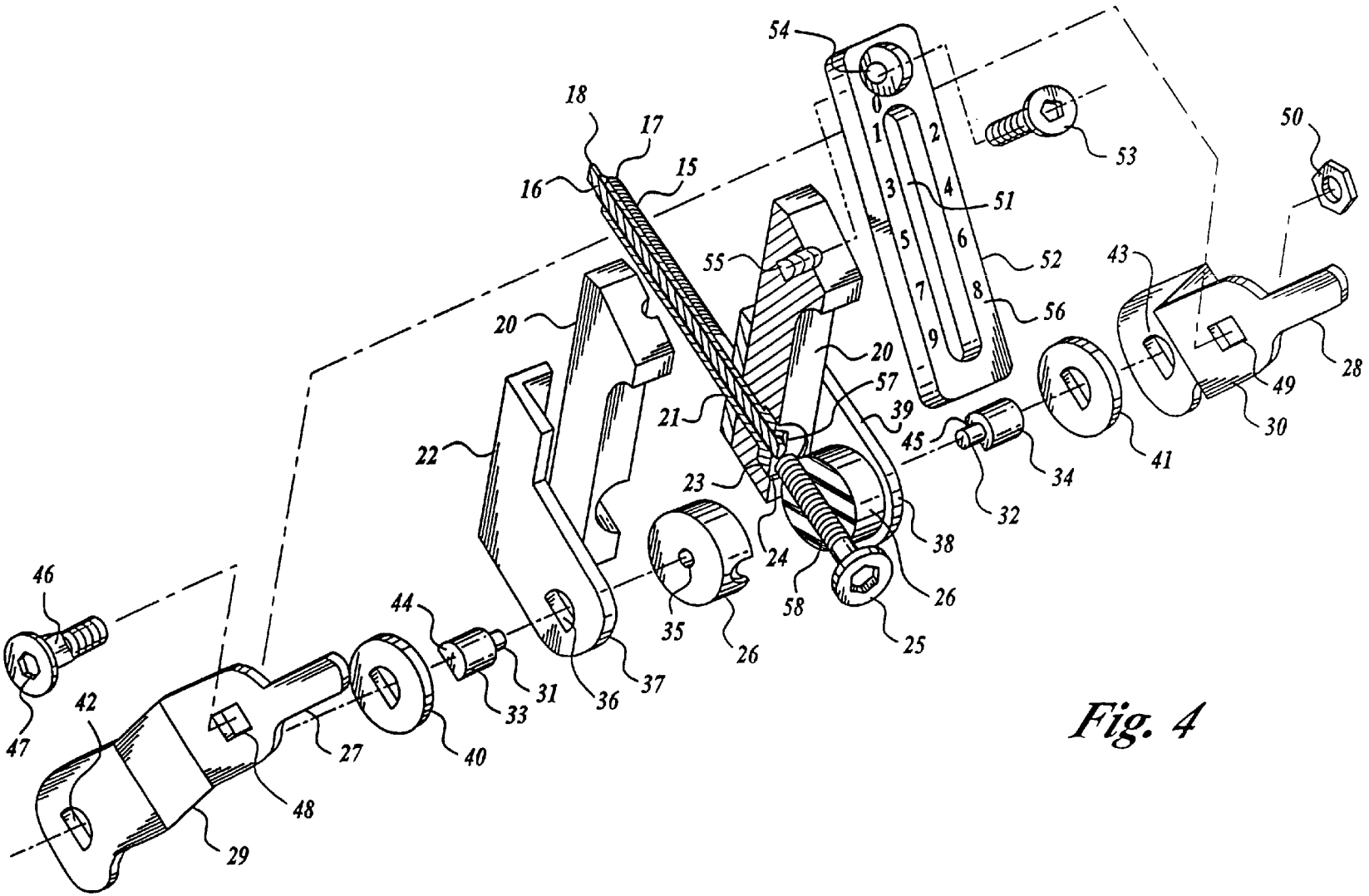
FIG. 4 is an exploded, sectional view of a preferred embodiment of the device.

FIG. 4 is an exploded, partially sectional view of the subject device. Fastener 15 extends through base 20 and hole 21 in bracket 22 and, when the device is installed, holds bracket 22 securely between the base and printing press. Head 23 of fastener 15 fits into countersink 24 and abuts the base. In an alternate embodiment the base and bracket are one piece. Pin 16 is secured in screw 25 with their centerlines coincident. Screw 25 is carried in barrel 26 with its centerline intersecting the centerline of the barrel. Lever assembly handle 19 comprises handles 27 and 28 on levers 29 and 30. Barrel 26 is carried on eccentric shafts 31 and 32 extending from shafts 33 and 34 respectively. The eccentric shafts engage hole 35 in the center of the barrel. Shafts 33 and 34 are carried in hole 36 in leg 37 of bracket 22 and hole 38 (not visible) in leg 39 of bracket 22. Washer 40 is carried on shaft 33 and washer 41 is carried on shaft 34. These washers fit between the legs of bracket 22 and levers 29 and 30. Flatted holes 42 in lever 29 and 43 in lever 30 engage the flatted portions 44 and 45 of shafts 33 and 34. Square portion 46 of screw 47 engages square hole 48 in lever 29 and hole 49 in lever 30 to hold the lever assembly together and in place and nut 50 holds the screw in place. Handles 27 and 28 fit through slot 51 in face plate 52 when the faceplate is attached to the body by screw 53 in countersunk hole 54 in the faceplate and threaded hole 55 in the body. Holes 42 and 43, shafts 33 and 34 and eccentric shafts 31 and 32 are configured such that as the handle of the lever assembly is moved in the slot the eccentric shafts move in an arc toward and away from the body, resulting in extension and retraction of end 15 of pin 16. Levers 29 and 30 are configured such that when nut 50 is tightened on screw 47 the levers are pressed toward the washers, bracket legs and barrel, causing friction which hold the lever assembly from inadvertent movement. In initial adjustment screw 25 is turned in the barrel such that ink flow is zero when the handle of the lever assembly is at position 0 according to the numbers on the faceplate, number 56 being typical. When the device is being installed, screw 25 and pin 16 are removed to provide access for an Allen™ wrench to engage socket 57 in screw 15.

Using an undersized tap to thread hole 58 in the barrel provides enough interference with a standard screw to assure that screw 25 holds its position in the barrel.

In use the handle of the lever assembly is adjusted in the faceplate slot to adjust ink flow in the nozzle portion influence by the device.

It is considered to be understandable from this description that the subject invention meets its objectives. It provides an ink flow adjustment device which provides a clear indication of its setting, is ergonomically advantageous, and requires no modification of the presses for installation and is durable.

It is also considered to be understood that while one embodiment of the invention is described herein, other embodiments and modifications of the one described are possible within the scope of the invention which is limited only by the attached claims.

I claim:

1. An ink flow adjustment device, comprising:

a hollow attachment fastener;

a rod, said rod being installed in said hollow fastener;

a screw secured to said rod, wherein a centerline of the rod is coincident with a centerline of said screw;

a barrel that is arranged to carry said screw through an undersized hole in said barrel such that said barrel provides sufficient interference with said screw to assure that said screw holds its position, wherein a centerline of said barrel is coincident with the centerline of said screw;

said device further comprising:

means for moving said rod endwise in said fastener; and means for supporting and attaching said means for moving by said fastener.

2. The device of claim 1 in which said means for moving comprises a lever assembly operated eccentric mechanism.

3. The device of claim 1 further comprising means for indicating the setting of the device.

4. The device of claim 2 further comprising means for indicating the setting of the device.

5. The device of claim 3 in which said lever assembly has a handle and said device further comprises a calibrated faceplate and said means for indicating comprises said handle and said calibrated faceplate.

6. The device of claim 4 in which said lever assembly has a handle and said device further comprises a calibrated faceplate and said means for indicating comprises said handle and said calibrated faceplate.

7. An apparatus for adjusting the flow of printing ink for a printing press, comprising:

a hollow fastener that is arranged to fasten the apparatus to the printing press;

a pin that is arranged to slide longitudinally through the hollow fastener such that movement of an end of the pin adjusts the flow of printing ink;

a screw that is secured to an opposite end of the pin;

a barrel that is arranged with an undersized hole such that when the screw is inserted into the barrel the selected position of the screw is maintained; and a lever assembly that is frictionally secured to the barrel such that friction holds the lever assembly from inadvertent movement.

8. The apparatus of claim 7, wherein the hollow fastener is arranged such that it is secured within a preexisting hole of the printing press.

9. The apparatus of claim 7, wherein the lever assembly further includes a handle, wherein an arc movement of the handle results in longitudinal movement of the pin.

10. The apparatus of claim 9, wherein the lever assembly further includes an eccentric shaft that engages another hole of the barrel, such that movement of the handle results in an arc movement of the eccentric shaft.

11. The apparatus of claim 9, further comprising a faceplate that is arranged with a slot, wherein the movement of the handle occurs within the slot.

12. The apparatus of claim 7, wherein a centerline of the screw is coincident with a centerline of the pin.

13. The apparatus of claim 7, wherein a centerline of the screw is coincident with a centerline of the hollow fastener.

14. The apparatus of claim 7, wherein the hollow fastener is arranged such that modification of the printing press is avoided.

15. A method for providing adjustment the flow of printing ink for a printing press, comprising:

fastening a levered device to the printing press with a hollow fastener while avoiding modification of the printing press;

initially adjusting ink flow with the levered device by turning a screw within an undersized hole of the levered device, wherein the undersized hole provides sufficient interference with the screw to maintain a selected position for the screw; and further adjusting ink flow with the levered device by moving a handle to a selected position such that a pin within the hollow fastener extends and retracts within the hollow fastener, wherein friction maintains the selected position of the handle.

16. The method of claim 15, wherein ink flow is zero after initially adjusting ink flow with the levered device.

17. The method of claim 15, wherein moving the handle to a selected position results in a movement of an eccentric shaft that results in extension and retraction of the pin.

18. The method of claim 15, further comprising connecting the handle of the levered device to a lever assembly within the levered device such that pressure developed within the levered device that provides the friction that maintains the selected position of the handle.

19. The method of claim 15, further comprising manufacturing the undersized hole within the levered device using an undersized tap to thread the undersized hole.

20. The method of claim 15, wherein fastening the levered device to the printing press further comprises engaging a socket of the hollow fastener with a tool for fastening the hollow fastener to the printing press.

* * * * *